United States Patent [19]

Koski et al.

[11] 4,452,669

[45] Jun. 5, 1984

[54] MULTI-NIP PRESS PORTION OF A PAPER OR CARDBOARD MACHINE

[75] Inventors: Erkki Koski; Olli Tapio, both of Jyväskylä, Finland

[73] Assignee: Valmet Oy, Finland

[21] Appl. No.: 365,559

[22] Filed: Apr. 5, 1982

Related U.S. Application Data

[63] Continuation-in-part of Ser. No. 287,299, Jul. 27, 1981.

[30] Foreign Application Priority Data

Dec. 3, 1981 [FI] Finland ..... 813875

[51] Int. Cl.[3] ..... D21F 2/00; D21F 3/04

[52] U.S. Cl. ..... 162/305; 162/306; 162/359; 162/360

[58] Field of Search ..... 162/305, 301, 306, 358, 162/359, 360, 297

[56] References Cited

U.S. PATENT DOCUMENTS

| | | | |
|---|---|---|---|
| 4,056,433 | 11/1977 | Koponen et al. | 162/305 |
| 4,059,482 | 11/1977 | Kankaanpaa et al. | 162/305 |
| 4,110,156 | 8/1970 | Stotz | 162/305 |
| 4,219,383 | 8/1980 | Valkama | 162/305 |

*Primary Examiner*—Steve Alvo

*Attorney, Agent, or Firm*—Steinberg & Raskin

[57] ABSTRACT

A multi-nip press portion or section of a paper or cardboard machine wherein a web is detached from a forming wire by a pick-up roller and transferred onto a first fabric which carries the web into the first nip and wherein the press section includes at least two water-removing press nips which include a common smooth-surface central roller. The central roller has a downwardly facing open sector with which a scraper is associated for passing the web in the case of a break to a pulper or the like. The first nip, which can constitute a press nip and/or a transfer nip is formed by a counter-roller situated in nip-defining relationship with the pick-up roller. A second fabric passes through the first nip over the counter-roller and carries the web on its upper face from the first nip to a second double-fabric nip through which the second fabric, constituting a lower fabric, and a third fabric, constituting an upper fabric pass. The third fabric has a substantially vertical run on which the web is carried from the second nip to a third nip defined by a press roller and the smooth-surfaced central roller. After passing through the third nip, the web separates from the third fabric and follows the surface of the central roller to either a following nip or nips or to a web detachment point.

14 Claims, 4 Drawing Figures

MULTI-NIP PRESS PORTION OF A PAPER OR CARDBOARD MACHINE

BACKGROUND OF THE INVENTION

This application is a continuation-in-part of application Ser. No. 287,299 filed July 27, 1981.

The present invention relates generally to paper or cardboard machines and, more particularly, to multi-nip press portions or sections of paper or cardboard machines.

Specifically, the present invention concerns a multi-nip press section of a paper or cardboard machine wherein the web is detached from the forming wire by means of a pick-up roller and is simultaneously transferred onto a first fabric which functions as a pick-up fabric. The web is passed to the first nip on the first or pick-up fabric and then passes to at least two water-removing press nips, the last ones of which in the direction of web passage are formed around a smooth-surface central roller. The central roller preferably has a downwardly facing open sector with which a scraper may be operatively associated for passing the web, for example in the case of a web break, to a pulper situated beneath the central roller or onto other equipment for transporting the waste material. The web is detached from the central roller for subsequent passage to the drying section of the paper machine.

After the wire section of a paper machine, the water content of a paper web is usually about four times the fiber content thereof. For this reason the web structure at this stage of formation is not permanently fixed. Moreover, the strength of the web at this stage is often insufficient to withstand the strains imposed on it in the paper machine. For these reasons, the web is passed after the forming section into a press section of the paper machine through several press nips by rollers which act against one another. The water content of the web is reduced in the press nips and, at the same time, the strength of the web is increased.

Such a mechanical dewatering treatment will of course affect several aspects both of the operation of the paper machine as well as the ultimate properties of the paper produced such, for example, as the strength, compactness and porosity of the paper. It is also known that the maximum dry-matter content which can be obtained in the web through mechanical pressing has theoretical and practical limits. In order to attain a dry matter content which exceeds such limits, further dewatering must be accomplished by means of evaporation or the like.

It is also recognized that up to certain limits, mechanical dewatering of the web by pressing the web in press nips is considerably less expensive than dewatering the web of a corresponding amount of water through evaporation. Therefore, it is usually an objective to obtain the most efficient dewatering of the web in the press section of the paper machine as is possible and in this connection the web is generally subjected to relatively high compression through the press nips.

However, the relatively low strength of the wet web after the forming section implies certain restrictions on the extent of the compression which can be applied to the web. Thus, an excessively high compression may destroy the fiber network which constitutes the web. In order to prevent this circumstance, considerable attention is usually given to the arrangements of the rollers of the press section with a view towards achieving an optimum dewatering capacity in the press section without any consequent deterioration of the quality and strength of the finished paper product.

A press nip of a paper machine press section is generally formed between two rollers, one of which usually has a smooth-surface while the other has a recessed surface configuration, a felt usually passing between the rollers. The paper web is passed to the press nip in a manner such that it passes between the smooth-surface roller and the felt. The felt facilitates the drainage of water which has been pressed from the paper web and reduces the extent to which the paper is marked with the pattern of the recessed surface of one of the press rollers.

The nip usually has only a single felt so that water is removed from the web in a single direction, i.e., through the surface of the web which contacts the felt. However, dewatering of the web in one direction has the drawback that the structure of the web tends to acquire one-sided characteristics since fine fibers and filler agents readily shift along with the water being expressed and tend to accumulate proximate to the surface of the web from which the water is removed. In order to prevent such one-sidedness, press nips in which large quantities of water are to be removed from the web and in which a definite risk therefore exists of biassing the structure of the web can be provided with two felts such that the paper web passes through the nip between the two felts. In such double felted nips, it is preferred that both of the rollers defining the nip are of the recessed-surface type. In this connection, recessed-surface rollers include, for example, punched rollers, suction rollers, blind-drilled rollers, grooved rollers and the like.

Pressing of the web between two felts is also advantageous from the viewpoint of the dewatering operation itself. Thus, the dewatering of the web is facilitated in certain cases so that a particular dry-matter content of the web can be obtained with a lower compression imposed on the web than in the case of a single-felted nip. Of course, this fact results in a lower strain being imposed on the structure of the web as it passes through the nip than in the case where higher pressures are present. On the other hand, the compression between the rollers of a double-felted nip can be increased to a certain limit, as compared with a single-felted nip, without risking the damage to the web.

The present invention has as one of its starting points the further development of the "Sym-Press" press section ("Sym-Press" is a Trademark of Valmet Oy, assignee of the present application) which has resulted from experience in the operation of this press section over several years.

Reference is made to Finnish Announcement Publication No. 50,651 (which corresponds to U.S. Pat. No. 4,285,766) with respect to the details of the "Sym-Press" press section. Briefly, the "Sym-Press" press section is a compact, so-called fully closed press section in which the paper web which enters from the wire section is passed through a first nip constituted by two recessed surface and/or suction rollers and between two felts with water being removed from both of the surfaces of the paper web. The press section includes a smooth-surface roller which is provided with at least one scraper device. A second nip is formed against the smooth-surfaced roller by one of the recessed-surface rollers which define the first nip. The web is dewatered in the second nip through the surface of the web which faces the recessed-surface roller of the first nip. In this known press section, at least one additional nip is provided after the second nip, the additional nip being formed between the smooth-surface central roller, whose diameter is preferably larger than the diameters of the other press rollers in the press section, and a recessed-surface roller, and another felt passing through this additional nip. This additional press nip is preferably situated with respect to the smooth-surface central roller substantially diametrically opposite from the second nip.

Reference is also made with respect to the prior art relating to the present invention to U.S. Pat. No. 4,257,844 and to the publications in *Das Papier,* Heft 1, pages 33 to 34, 1981, and *Norsk Skogindustri,* No. 3, 1974, page 80.

In the latter two publications, a modification of the "Sym-Press" press section, described above, is suggested wherein the "Sym-Press" suction roller does not form a nip with the smooth-surface central roller and wherein a first double-felted press nip is arranged in connection with or prior to this suction roller and in which nip the removal of water takes place in two directions. In the place of the "Sym-Press" suction roller, a recessed-surface press roller is utilized which forms the second press nip with the smooth-surfaced central roller of the press section. A third press nip is formed substantially on the opposite side of the smooth-surfaced central roller relative to the second nip.

Further with respect to the background of the present invention, reference is made to applicant's U.S. patent application Ser. No. 287,299, of which this application constitutes a continuation-in-part. A closed press section of a paper machine is disclosed in this application wherein the paper web coming from the wire section is supported by a first fabric and passed between two fabrics through a first double-felted nip formed by a pair of recessed-surface rollers and in which nip water is removed from the web through both surfaces thereof. The press section includes a smooth-surfaced roller against which at least two single-felted nips are formed, in the first nip of which the press fabric is constituted by the first fabric which carried the web into the first double-felted nip. The first single-felted nip is situated at a certain distance from the first double-felted nip and the web passes from the first double-felted nip to the first single-felted nip supported by the first fabric. The web is detached from the first fabric and adheres to the face of the smooth-surface roller and moves on that roller face to the second single-felted nip which is provided with its own press fabric.

An advantageous feature of the press section discussed above is that there is no need for a suction roller so that the first double-felted press nip is formed between a pair of solid-mantle, recessed-surface rollers. The passage of the first or upper fabric and the web carried thereby is in an upward direction prior to the first double-felted nip as guided by the press roller situated within the loop of the first fabric over an appropriate sector whose magnitude is preferably between about 30° and 150°. The web is supported from the outside over at least a substantial portion of the sector of the press roller situated within the first fabric loop by a second, lower fabric which also operates in the first double-felted press nip and which second fabric is detached from the web substantially immediately after the first double-felted nip. In press sections of the type disclosed in applicant's application Ser. No. 287,299, and in U.S. Pat. No. 4,257,844 of Beloit Corporation of Beloit, Wis., a drawback has been observed in that as the same upper felt operates both as a pick-up felt as well as a press felt in the first double-felted nip and in the following single-felted nip, it is difficult to obtain an appropriate felt whose properties are satisfactory for efficiently performing all of these functions. Thus, the optimum properties of a pick-up felt and of a dewatering felt are quite different relative to each other. Since most of the water to be removed from the web is removed in the first nips where the felt functions as a dewatering fabric, it is difficult to find a felt having a sufficiently high dewatering capacity, especially in the case of cardboards and thicker paper types, which felt also has satisfactory pick-up properties.

Further in connection with the state of the art relating to the present invention, reference is additionally made to Finnish Patent Application No. 2844/74, corresponding to U.S. Pat. No. 4,059,482 assigned to the assignees of the instant application, and to Finnish Patent Application No. 2845/74 corresponding to U.S. Pat. No. 4,188,262. In these publications, a multi-nip press section of a paper machine is disclosed whose basic construction is that of the "Sym-Press" press section and wherein the press section is preceded by a pre-pressing nip which is arranged in connection with the pick-up roller, or by a corresponding transfer nip in which no substantial compression exists. However, these press sections have the same drawbacks associated with the "Sym-Press" press section, such as the fact that the suction roller of the press section must have relatively large dimentions due to its high loading so that the press-suction roller is a relatively expensive component of the press section.

With still further reference to the state of the art, reference is made to U.S. Pat. Nos. 3,861,996 and 4,219,383.

SUMMARY OF THE INVENTION

Accordingly, one object of the present invention is to provide a new and improved multi-nip press section of a paper machine.

Another object of the present invention is to provide a new and improved multi-nip press section which is especially suitable in the manufacture of thicker paper types, cardboard and the like.

Still another object of the present invention is to provide a new and improved press section in which the distribution of material, e.g., fine material, filler agents, and other additives, in the web being produced can be controlled by adjusting the amount of dewatering and the direction of dewatering at the various nips in the press section.

A still further object of the present invention is to provide a new and improved press section of a paper machine in which the web can be reliably passed in a closed path without the risk of web breakage.

Yet another object of the present invention is to provide a new and improved press section which retains all of the advantages of the "Sym-Press" press section and which does not have any of the disadvantages thereof.

Briefly, in accordance with the present invention, these and other objects are attained by providing an improvement in a multi-nip press section of a paper or cardboard machine wherein a web is detached from a forming wire by a pick-up roller and simultaneously transferred onto a first fabric which operates as a pick-up fabric and on which the web is passed to a first nip, the press section including at least two water-removing press nips situated after the first nip in the direction of web passage, the last of the water-removing nips being formed around a smooth-surface central roller, and wherein the web is detached from the central roller for passage to the drying section of the paper machine. More particularly, the improvement of the invention is mainly characterized in the combination wherein the first nip, which can constitute a press and/or transfer nip, is formed by a counter-roller situated in nip-defining relationship with the pick-up roller, that a second fabric passes through the first nip and over the counter-roller, the web being carried on the upper face of the second fabric to a second nip of the press section, that the second nip is a double-fabric nip through which the second fabric and a third fabric pass, the second fabric constituting a lower fabric and the third fabric constituting an upper fabric, that the third fabric has a substantially vertical run on which the web is carried from the second press nip to a third press nip, the latter being formed between the central roller and a press roller situated within a loop of the third fabric, and that after the third nip, the third fabric is separated from the web which then passes on the face of the smooth-surface central roller to the following nip or to a web-detachment point. The provision of a transfer or press nip at the pick-up roller in accordance with the present invention provides the important advantage that the web is transferred onto the second fabric of the press section where it is supported from below. This is advantageous with respect to the conventional "Sym-Press" press section wherein the web is introduced into the first nip of the press section while carried on the lower face of the pick-up fabric. This feature is especially advantageous when the press section is used in the manufacture of relatively heavy webs. Another important advantage obtained is that any suction rollers forming a part of the press section can be manufactured in a more durable manner yet with reduced dimensioning relative to the suction rollers utilized in convention "Sym-Press" press sections. Moreover, an additional advantage is obtained in the present invention in that the number of the press-suction rollers required is minimized and, in some embodiments, the requirement for even a single press-suction roller provided with a conventional internal suction box is eliminated. It will be understood that the term "fabric" or "press fabric" as used herein refers to all felt-like products, whether made of artificial or natural fibers, and which are usually utilized in paper machines and, in particular, in the press sections of paper machines, either to promote the removal of water from the web or to carry the wet web from one processing step to the next.

DESCRIPTION OF THE DRAWINGS

A more complete appreciation of the present invention and many of the attendant advantages thereof will be readily appreciated as the same becomes better understood by reference to the following detailed description when considered in connection with the accompanying drawings in which.

DESCRIPTION OF THE PREFERRED EMBODIMENTS

Figure 1:
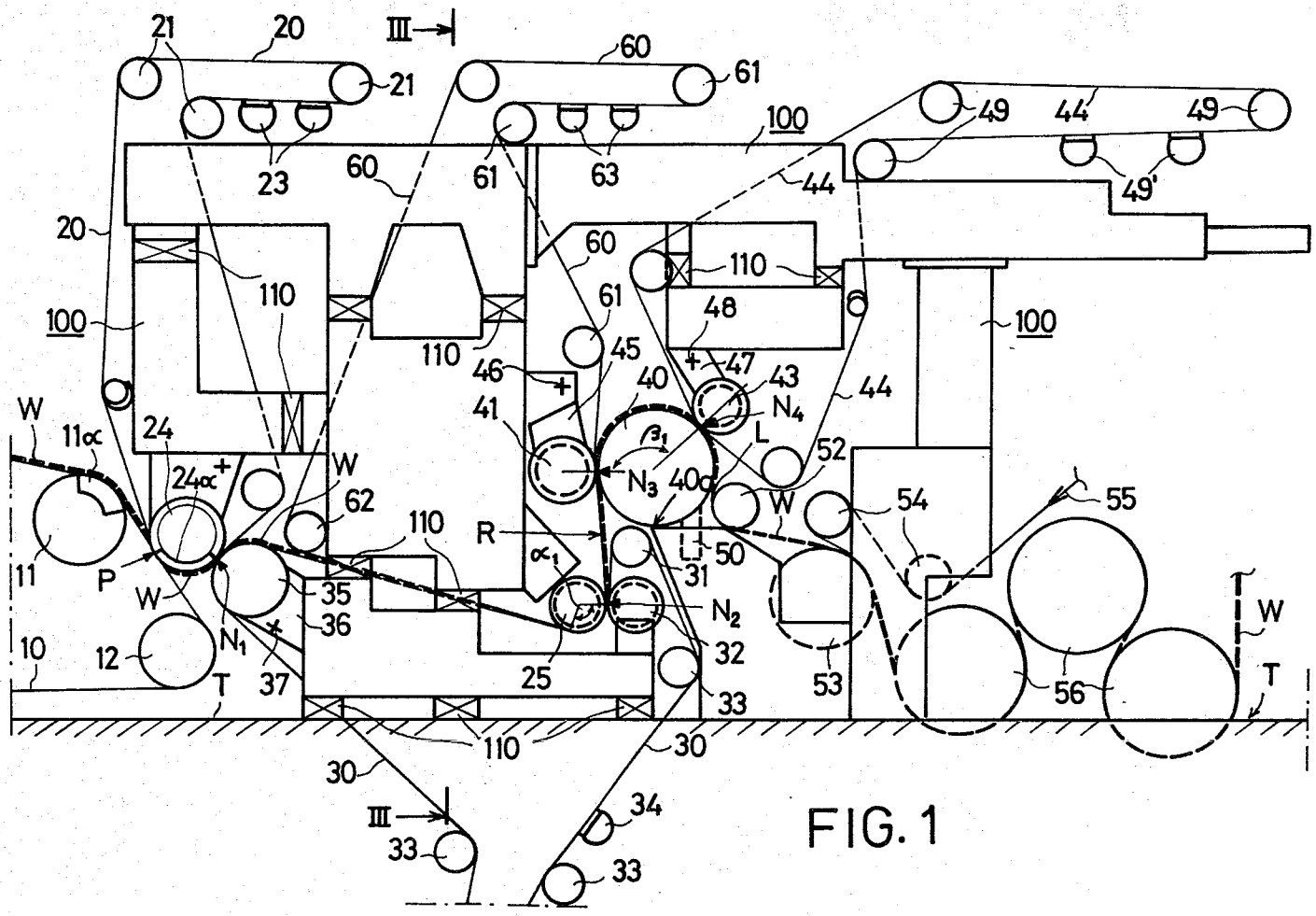
FIG. 1 is a schematic side elevation view of a first embodiment of the present invention.
Figure 2:
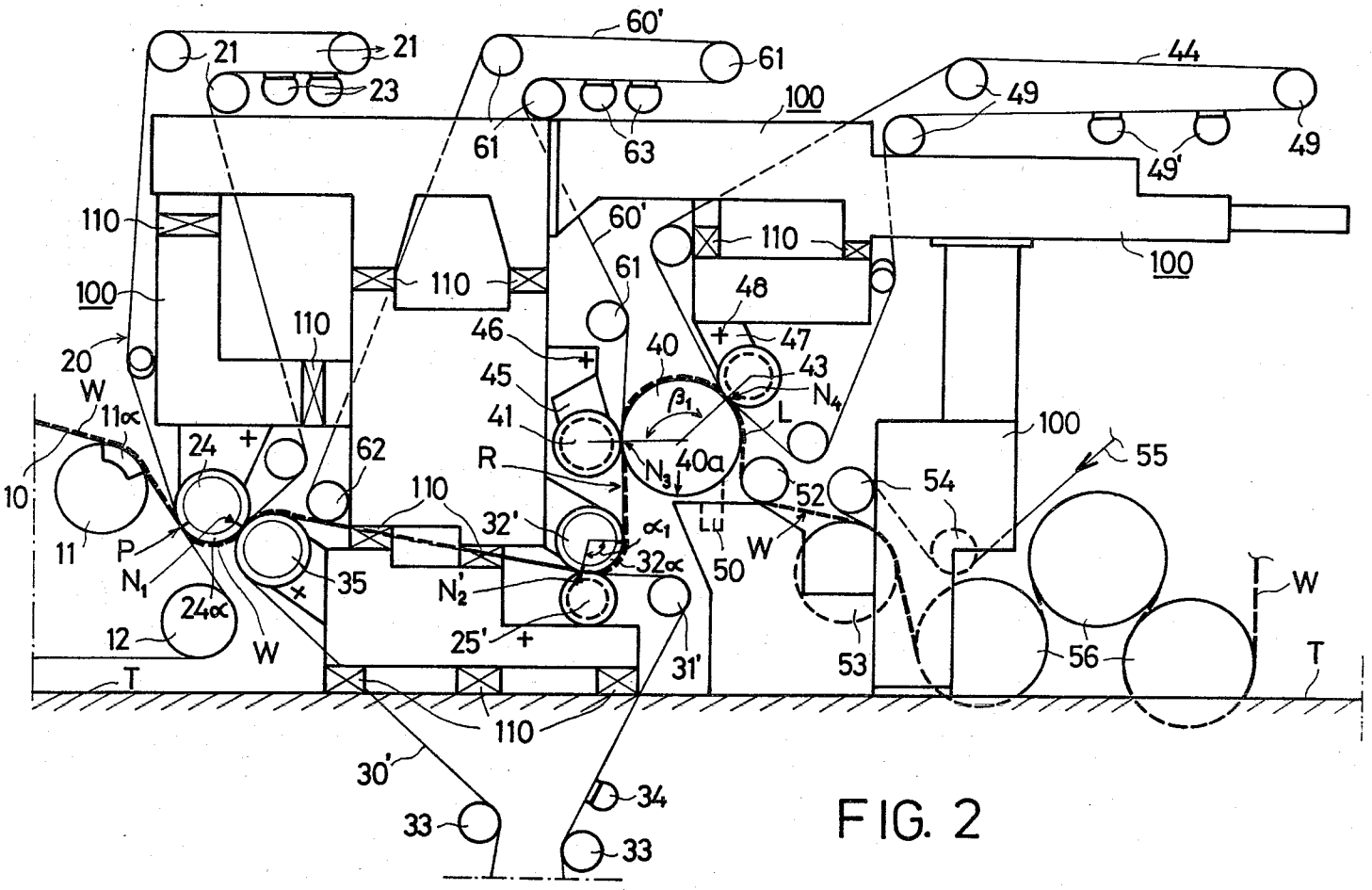
FIG. 2 is a view similar to FIG. 1 illustrating a second embodiment of the present invention.

Referring now to the drawings wherein like reference characters designate identical or corresponding parts throughout the several views, and more particularly to FIGS. 1 and 2, the web W entering into the press section is formed on the forming wire 10 and is detached therefrom at a point P on a downwardly slanting run of the wire 10 between the rollers 11 and 12. The web W is detached from the forming wire 10 under the effect of a suction sector 24α of the pick-up roller 24 and simultaneously transferred onto a first or pick-up fabric 20. The roller 11 is also provided with a suction sector 11α. Thus, the first fabric 20 functions as both a pick-up fabric as well as the first press fabric in the first press and/or transfer nip $N_1$ of the press section.

The press section of the present invention comprises four fabrics, namely, the first fabric 20 which functions as a pick-up fabric, a second fabric 30 (30' in FIG. 2), a third fabric 60 (60' in FIG. 2), and a fourth fabric 44. After separating from the forming wire 10 at the detachment point P, the web W runs on the pick-up fabric 20 under the effect of the suction zone 24α of the pick-up roller 24 into the first nip $N_1$ which is formed by a counter-roller 35 which is situated in nip-defining relationship with the pick-up roller 24. The web W is shifted onto the second fabric 30 (30') under the effect of the surface properties of the second fabric and/or by the effect of the suction zone (not shown) of the counter-roller 35. After passing through the nip $N_1$, the web W is carried on the upper face of the second fabric 30 (30') in a substantially horizontal and preferably slightly downwardly slanting run to the second press nip $N_2$. The second press nip $N_2$ is a double-felted nip through which the second fabric 30 (30') and the third fabric 60 (60') pass. The second fabric 30 (30') guided by guide rolls 33 constitutes a lower fabric while the third fabric 60 (60') which is guided by guide rolls 61 constitutes an upper fabric. Conventional felt reconditioning devices for the third fabric 60 (60') are designated 63 in FIGS. 1 and 2.

A portion of the run of the third fabric 60 (60') is guided onto the web W by the guide roller 62. Moreover, the illustrated arrangement by which the second fabric 30 (30') travels between the first and the second nips $N_1$ and $N_2$ is advantageous in that the web W is supported by the fabric from beneath so that a highly reliable guidance of the web W is obtained.

The first nip $N_1$ is a double-fabric nip, the first fabric 20 and the second fabric 30 (30') passing therethrough. The first nip $N_1$ can constitute either a mere transfer nip in which relatively small compression is present or an actual dewatering nip in which considerable pressure is applied to the web and wherein dewatering will occur in two directions. If the nip $N_1$ functions as a dewatering nip, the counter-roller 35 should preferably be constituted by a dewatering roller such, for example, as a recessed-surface roller or a press-suction roller provided with a suction zone. However, it is understood that a smooth-surface roller may also be utilized. The construction and arrangement of the counter-roller 35 will be further discussed below in connection with FIG. 3.

The third fabric 60 (60') has a substantially vertical run, designated R, between the second and a third press nips $N_2$ and $N_3$. Thus, as seen in FIG. 1, after passing through the second press nip $N_2$, the third fabric 60 is directed upwardly along a run R and it supports the web W which moves into the third nip $N_3$ in which the third fabric 60 (60') also functions as a press fabric. The third nip $N_3$ is formed between a smooth-surface central roller 40 and a recessed-surface press roller 41 which is situated within the loop of the third fabric 60 (60'). The smooth-surface or solid-mantle central roller 40, whose diameter is preferably greater than the diameter of the other press rollers, is, for example, a granite roller. In this connection, the use of a granite roller is advantageous in that the adhesion of the web W to the face of the roller 40 will be higher than its adhesion to the felts 60 (60'), 44 (44') and that the web W can still be easily detached from the face of the granite roller through the effect of a speed differential when the web is shifted from the press section into the drying section. A fourth press nip $N_4$ is also formed against the central roller 40 by means of a recessed-surface press roller 43. The press roller 43 is situated within the loop of a fourth press fabric 44 which passes through the fourth press nip $N_4$. The fabric 44 is guided by guide rollers 49 and reconditioning devices for the fourth fabric 44 are designated 49'.

Referring to FIG. 1, as discussed above the second press nip $N_2$ is formed between the press rollers 25 and 32 and constitutes a double-fabric nip. The third fabric 60 operates as the upper felt while the lower felt is constituted by the second fabric 30. The guide rollers of the lower or second felt 30 and which are situated beneath the level T of the floor are designated 33 and the felt reconditioning device is designated 34.

Referring in particular to the embodiment of the invention illustrated in FIG. 1, the dewatering press nips do not require any costly suction roller or equivalent suction device, the only suction device being the pick-up suction roller 24. In order to achieve this advantageous feature, the second press nip $N_2$ is also formed between two recessed-surface rollers 25 and 32. Moreover, the second press nip $N_2$ constitutes a substantially vertical nip through which the second and third fabrics 30 and 60 pass in a substantially vertical direction. The recessed-surface rollers 25 and 32 have respective axes which are substantially situated in a common horizontal plane to define the vertical nip $N_2$.

Referring now to FIG. 2, the second press nip $N_2'$ constitutes a substantially horizontal nip through which the second and third fabrics 30' and 60' pass in a substantially horizontal direction. The second press nip $N_2'$ is formed between a lower press roller 25' and an upper press roller 32', the lower roller 25' being an efficiently dewatering recessed-surface roller, such as a grooved roller, while the upper roller 32' constitutes a press-suction roller provided with a suction zone 32$\alpha$. The suction zone 32$\alpha$ extends over a sector $\alpha_1$ of the roller 32' and assures that the web W will follow the third fabric 60' as the latter changes its direction over the sector $\alpha_1$ towards the third nip $N_3$ to the upwardly directed run R. Thus, the position of the guide roller 31' of the fabric 30' can be selected in a manner such that the fabric 30' will follow the web W over some distance on the sector $\alpha_1$ after the zone of the nip $N_2'$ and thereby guarantee that the web will fabric 60'.

The smooth-surface central roller 40, which is preferably journalled to the frame structure 100 of the paper machine so that its axis is fixed, has a downwardly facing open sector 40*a* between the nips $N_3$ and $N_4$, which sector is provided with a scraper device 50. In the event of a web break, the scraper 50 will guide the paper web into a reject pulper (not shown) or the like which is situated beneath the press section.

The paper web W is detached from the smooth surface of the central roller 40 at point L by means of the speed differential which exists between the press section and the drying section of the paper machine and is guided by a guide roller 52 into the drying section of the paper machine. The lead-cylinder 53 and drying cylinders 56 of the drying section are illustrated in FIGS. 1 and 2. A single-felt guide is preferred for use in the drying section, such guidance being accomplished by a felt 55 which is guided by guide rollers 54.

In a preferred embodiment of the invention, the first and second nips $N_1$, $N_2$ ($N_2'$), constitute efficiently dewatering double-felted nips. In particular, such construction is especially preferred when the press section is utilized in connection with the manufacture of thick paper types, cardboard and the like. Accordingly, water is removed from the paper web W in these nips in a two-sided and substantially symmetrical manner whereupon the web W will have a relatively high dry-matter content subsequent to passing through the second nip $N_2$ ($N_2'$). In this case, the removal of water from the web W in the third and fourth nips $N_3$ and $N_4$, as well as in any additional nips when present, which water removal will be in a single direction in these single-felted nips and which will be of relatively low amounts, will not have any substantial detrimental effect on the distribution of material within the web W. Moreover, since a relatively high dry-matter content is obtained for the paper web W in the nips $N_1$, $N_2$ ($N_2'$), the change in the direction of the web as it travels over the sector $\alpha_1$ of the roller 25 (32') is accomplished in a safe and reliable manner. Furthermore, the passage of the web W from the second nip $N_2$ to the third nip $N_3$ on the run R of the third fabric 60 (60') which is not supported by any roller surface is accomplished without any substantial risk of web breakage.

Figure 3:
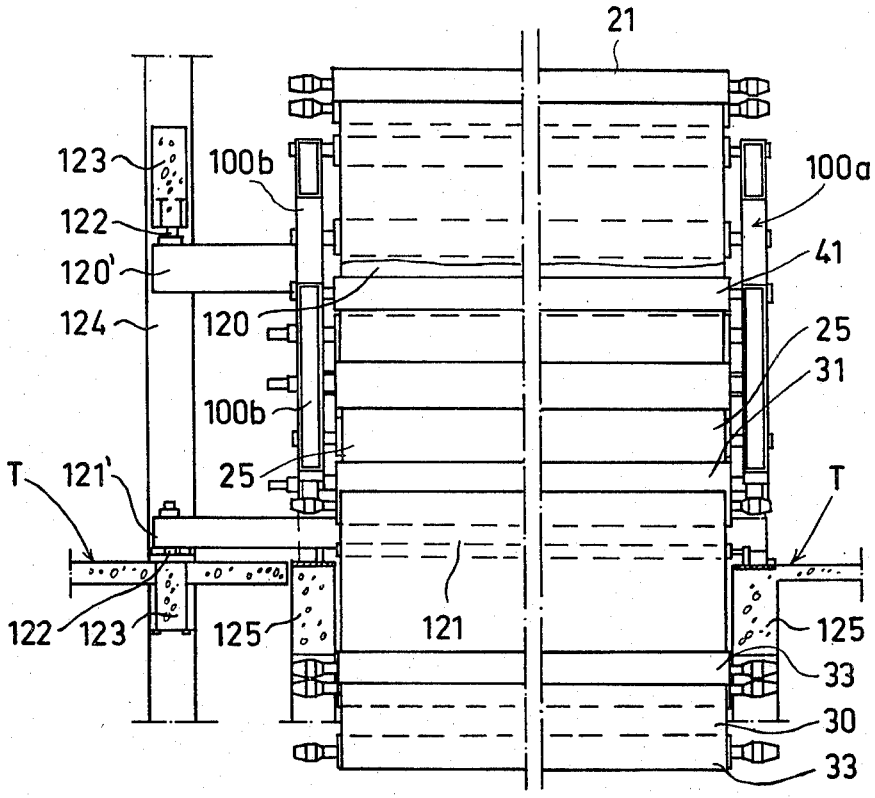
FIG. 3 is a section view taken along line III—III of FIG. 1.

The frame structure of the paper machine, generally designated 100, is schematically illustrated in FIGS. 1, 2 and 3. In a known manner, vertical beams lOO*a* of the frame structure 100 (FIG. 3) are provided with intermediate members 110 (FIGS. 1 and 2) which can be opened for purposes of replacing the fabrics 20, 30 (30'), 60 (60') and 44.

Referring to FIG. 3, a vertical section of the frame structure of the press section is illustrated. The frame structure includes beams 120 and 121 which are supported by the frame of the building of the paper machine hall through beam extensions 120' and 121'. Such support is facilitated through the provision of rods 122 which bear on horizontal beams 123. The beams on the service side of the press section are designated 100*a* in FIG. 3 while the beams situated on the operation side of the press section are designated 100*b*. The floor level of the paper machine is designated T and as seen in FIG. 3 side beams 125 are provided beneath the floor level T at both sides of the paper machine.

As mentioned hereinabove, the particular construction of the counter-roller 35 is determined by the particular function of the first nip $N_1$, i.e., whether the nip $N_1$ functions merely as a low-pressure transfer nip or as an actual dewatering press nip. The counter-roller 35 may in any case constitute a smooth-surface roller, a blind-drilled roller, a grooved roller, or a press-suction roller provided with an internal suction box.

Figure 4:
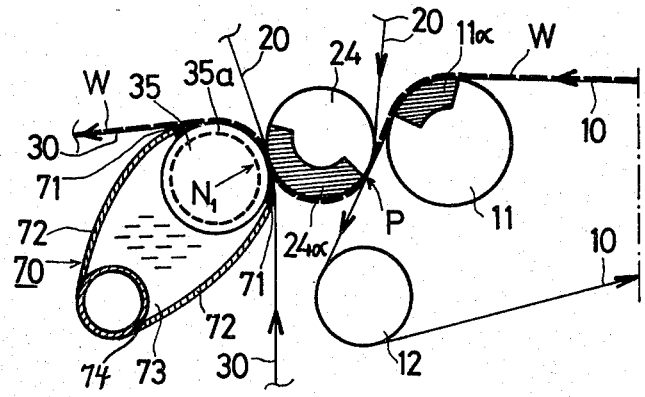
FIG. 4 is a schematic detail view illustrating an arrangement of the first nip of the press section of the present invention in which a suction box is provided exteriorally of the counter-roller.

Referring to FIG. 4, one preferred arrangement of the counter-roller 35 is illustrated. In this embodiment, the counter-roller 35 is provided with grooves 35*a* circumventing its mantle. An external suction box 70 extends over the sector of the roller 35 which is not lapped by the fabric 30. Sealing fillets 71 are provided at the outer edges of the walls 72 of the suction box 70 and sealingly engage the boundaries of the open sector of roller 35. Of course, the lateral sides of the suction box 70 are provided with appropriate sealing fillets (not shown). The interior space 73 of the suction box 70 defined by the walls 72 is connected via conduit 74 to a conventional suction system (not shown). In this manner the suction prevailing in the interior space 73 is applied over the sector of roller 35 which is lapped by the fabric 30 through the grooves 35*a*. It is also possible to provide an additional fabric such that it travels around the roller 35 with the suction box 70 being situated within its loop. An external suction box 70 of the type described above may also be operatively associated with rollers 11, 24 and 32'.

It may also be advantageous in certain cases to provide a vapor-supply box over the web W as the same is carried on the run R of the fabric 60 (60') between the nips $N_2$ and $N_3$ in order to intensify dewatering of the web in the subsequent nips as suggested in applicant's parent application Ser. No. 287,299. As to the construction, operation and effect of the vapor or steam-supply box, reference is made to U.S. Pat. No. 4,163,688.

As seen in FIGS. 1 and 2, the angle $\alpha_1$ is preferably larger than or substantially equal to 90° and the run R of the third fabric 60 (60'), although extending substantially vertically, slightly slants in a rearward direction relative to the overall direction of web passage through the press section which is also advantageous in that, if necessary, up to three press nips can be provided in connection with the central roller 40 while still maintaining a downwardly open sector 40*a* in connection with which a scrapper 50 can be provided to guide the reject paper and clean the surface of the roller 40. The angle $\beta_1$ constituting the angular distance between the third and fourth press nips $N_3$ and $N_4$ is generally greater than about 90° and can be as large as about 180°.

In the preferred embodiment illustrated in FIG. 1, the press rollers 25 and 40 are journalled in bearing supports which are fixedly mounted in the frame structure. The central roller 40 is illustrated as being supported from below although it is understood that the roller 40 may be supported equally as well from above by means of bearing supports associated with the frame structure. Moreover, in the FIG. 1 embodiment, rollers 32, 35, 41 and 43 are suspended from arms which are supported by conventional variable load apparatus in order to provide a suitable hip pressure in the respective nips. Thus, FIG. 1 illustrates arms 36, 45 and 47 which are mounted to the frame structure 100 by means of link pins 37, 46 and 48, respectively.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a multi-nip press section of a paper or cardboard machine or the like wherein a web is detached from a forming wire by a pick-up roller and simultaneously transferred onto a first fabric operating as a pick-up fabric and on which the web is passed to a first nip, said press section including at least two water-removing press nips situated after said first nip in the direction of web passage, the last of said water-removing nips being formed around a smooth-surface central roller, and wherein the web is detached from said central roller for passage to the drying section of the paper machine, the improvement comprising:

said first nip being formed by a counter-roller situated in nip-defining relationship with said pick-up roller;

a second fabric passing through said first nip and over said counter-roller, the web being carried on the upper face of said second fabric to a second nip of said press section;

said second nip being formed between first and second press rollers and constituting a double-fabric nip, said second fabric and a third fabric passing through said second nip, said second fabric constituting a lower fabric and said third fabric constituting an upper fabric;

said third fabric having a substantially vertical straight run, not supported by any roller, between said second and a third nip, the web being carried on said vertical straight and unsupported run of said third fabric from said second to said third press nip of the press section, said third press nip being formed between said central roller and a third press roller situated within a loop of said third fabric; and wherein after said third nip, said third fabric is separated from the web, said web passing on the face of said smooth-surface central roller to either a subsequent nip or to a web-detachment point.

2. The combination of claim 1 wherein said smooth-surface central roller has a downwardly facing open sector.

3. The combination of claim 2 wherein a scraper is provided in operative relationship with said open sector of said central roller for passing the web in the case of a web break to a pulper or the like.

4. The combination of claim 1 wherein said first press nip is a dewatering press nip.

5. The combination of claim 4 wherein said pick-up roller is a suction roller which functions as a press roller, and wherein said counter-roller is situated within a loop of said second fabric and comprises a dewatering roller.

6. The combination of claim 5 wherein said counter-roller comprises a recessed-surface roller.

7. The combination of claim 5 wherein said counter-roller comprises a suction-press roller.

8. The combination of claim 1 wherein said first nip is a relatively low pressure transfer nip and wherein said counter-roller is situated within a loop of said second fabric and comprises a transfer roller.

9. The combination of claim 8 wherein said counter-roller comprises a suction transfer roller.

10. The combination of claim 1 wherein said second double-fabric nip is a substantially vertical nip through which said second and third fabrics pass in a substantially vertical direction, said second nip being formed between said first and second press rolls constituted by a pair of recessed surface press rollers having respective axes substantially situated in a common horizontal plane, and wherein after said second nip said second fabric is separated from the web which is then carried by said third fabric over its substantially vertical run to said third nip.

11. The combination of claim 10 wherein the third fabric is guided over a first sector of one of said recessed surface rolls which is located inside the loop of said third fabric prior to said second nip such that the direction of said third fabric is changed to be directed vertically upwardly, and wherein the second fabric which passes through said second nip is guided over a second sector of said one of said recessed surface rolls which comprises at least a substantial portion of said first sector to provide external support for the web prior to said second nip, and wherein said press section includes only non-suction press rolls.

12. The combination of claim 1 wherein said second double-fabric nip is a substantially horizontal nip through which said second and third fabrics pass in a substantially horizontal direction, said second nip being formed between said first and second press rolls constituted by a lower recessed surface roll and a suction press roll situated over said lower recessed surface roll having a suction sector, and wherein the web follows said third fabric as it passes over said suction sector under the effect of said third nip.

13. The combination of claim 1 wherein at least one of said pick-up roller, counter-roller, and roller situated within the loop of said third fabric and forming the second press nip, is provided with external suction box means for applying suction to the fabric and web carried thereby as the same is carried over the respective roller.

14. The combination of claim 1 wherein the run of said second fabric after said counter-roller is slanted downwardly at a relatively small angle.

* * * * *